US012227715B2

(12) United States Patent
Bae et al.

(10) Patent No.: US 12,227,715 B2
(45) **Date of Patent: *Feb. 18, 2025**

(54) LUBRICATING OIL COMPOSITION

(71) Applicant: KONASOL CO., LTD., Dangjin-si (KR)

(72) Inventors: Yeon Joo Bae, Gyeongsangnam-do (KR); Keum Cheol Hwang, Hwaseong-si (KR); Im Joo Choi, Dangjin-si (KR)

(73) Assignee: KONASOL CO., LTD., Dangjin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/404,548

(22) Filed: Jan. 4, 2024

(65) Prior Publication Data

US 2024/0150671 A1 May 9, 2024

Related U.S. Application Data

(63) Continuation of application No. 17/897,250, filed on Aug. 29, 2022.

(30) Foreign Application Priority Data

Jul. 19, 2022 (KR) ..... 10-2022-0089072

(51) Int. Cl.
*C10M 169/04* (2006.01)
*C10M 125/02* (2006.01)
(Continued)

(52) U.S. Cl.
CPC ..... *C10M 169/04* (2013.01); *C10M 125/02* (2013.01); *C10M 129/92* (2013.01); *C10M 133/06* (2013.01); *C10M 141/06* (2013.01); *C10M 2201/041* (2013.01); *C10M 2203/003* (2013.01); *C10M 2207/10* (2013.01);
(Continued)

(58) Field of Classification Search
None
See application file for complete search history.

(56) References Cited

U.S. PATENT DOCUMENTS

2013/0115462 A1* 5/2013 Mazyar ..... B22F 1/0545 977/773
2014/0147627 A1* 5/2014 Aizenberg ..... F01D 25/18 428/141

FOREIGN PATENT DOCUMENTS

KR 10-2013-0041573 A 4/2013

OTHER PUBLICATIONS

Office Action mailed Dec. 26, 2022 by Korean Intellectual Property Office in Korean Patent Application No. 10-2022-0089072, along with machine translation.

* cited by examiner

*Primary Examiner* — Vishal V Vasisth
(74) *Attorney, Agent, or Firm* — MEI & MARK LLP

(57) ABSTRACT

Provided is a lubricating oil composition including a lubricating oil additive and a lubricating oil, the lubricating oil additive having nanodiamonds, of which a surface is hydrophobically modified by a surface treatment, dispersed in a base oil. The lubricating oil composition retains dispersibility over a long period of time and thus can ensure storage stability. Machines to which the lubricating oil composition is applied may have improved abrasion resistance as well as improved fuel consumption and reduced noise, and high thermal conductivity of the lubricating oil composition may also increase cooling efficiency and the service life of machines.

11 Claims, 8 Drawing Sheets

(51) Int. Cl.

| | |
|---|---|
| ***C10M 129/92*** | (2006.01) |
| ***C10M 133/06*** | (2006.01) |
| ***C10M 141/06*** | (2006.01) |
| *C10N 20/00* | (2006.01) |
| *C10N 20/06* | (2006.01) |

(52) U.S. Cl.
CPC ..... *C10M 2215/26* (2013.01); *C10N 2020/06* (2013.01); *C10N 2020/061* (2020.05)

(A) (B)

LUBRICATING OIL COMPOSITION

CROSS-REFERENCE TO RELATED APPLICATION

This is a continuation of U.S. patent application Ser. No. 17/897,250, filed on Aug. 29, 2022, now U.S. Pat. No. 11,866,672, which is incorporated herein by reference. This application is also based on and claims priority under 35 U.S.C. § 119 to Korean Patent Application No. 10-2022-0089072, filed on Jul. 19, 2022, in the Korean Intellectual Property Office, the disclosure of which is incorporated by reference herein in its entirety.

BACKGROUND

1. Field

The disclosure relates to a lubricating oil composition.

2. Description of the Related Art

In recent years as a variety of rotating devices become increasingly smaller, lighter, and faster, the usage of lubricant oils in severe conditions of operation, under heavier loads and at higher speeds, has also been increasing, and as such, there is a need for the development of a high-performance lubricating oil with enhanced thermal oxidation stability, abrasion resistance, and the like. Conventionally used as lubricant oil additives to enhance the performance of such lubricant oils are molybdenum disulfide ($MoS_2$), graphite, carbon nanotubes (CNT), Teflon (PTFE), and the like. However, these materials were found to undergo oxidation and lose their lubricating ability in high-temperature high-humidity environments.

With recent advancements in the nanotechnology, diamond powder for effectively exploiting the characteristics of diamond is produced, and in particular, nanodiamonds have garnered much attention as a key material in the field of lubricant oils.

Diamond is a material that is widely useful in almost all areas of industry including electronics and chemicals, for its many advantageous properties such as high rigidity, chemical stability (corrosion resistance, acid resistance, alkali resistance), high optical transmittance, high thermal conductivity, low thermal expansion, electrical insulation properties, and no toxicity and no carcinogenic effect on the human body and living organisms. Furthermore, nanodiamonds have a restorative ability that reconstructs worn areas of metal surfaces, and thus provide advantages such as increasing the longevity of machines, improving fuel consumption, reducing noise, and reducing pollutions caused by exhaust gas.

However, due to having a high proportion of surface atoms per particle, which results in a higher total sum of Van der Waals forces acting between the surface atoms of adjacent particles, nanodiamonds tend to form aggregates, and as a hydrophilic material, nanodiamonds are extremely difficult to disperse in hydrophobic solutions such as oils, compared to polar solutions. To address the above-mentioned issues, there have been active research on methods of particle surface modification to impart dispersibility and hydrophobicity to nanodiamonds.

SUMMARY

Examples of the disclosure aim to provide a lubricating oil composition having improved properties in terms of dispersion stability, thermal conductivity, abrasion resistance, and the like, by including nanodiamonds with a hydrophobically modified surface.

Additional aspects will be set forth in part in the description which follows and, in part, will be apparent from the description, or may be learned by practice of the presented embodiments of the disclosure.

According to one aspect of the disclosure, provided is a lubricating oil composition including: a lubricating oil additive containing nanoparticles dispersed in a base oil, the nanoparticles including a core and a shell surrounding the core; and a lubricating oil including the lubricating oil additive dispersed therein, wherein the core includes nanodiamonds, and the shell includes at least one of an unsaturated fatty acid and an amine-based compound.

In particular, the shell may further include a ceramic layer surrounding the core, and the ceramic layer may be surface-modified by the unsaturated fatty acid and/or the amine-based compound.

The ceramic layer may have on a surface thereof, one or more functional groups selected from a carboxyl group, a hydroxyl group, and an amino group, wherein the amino group may form a covalent bond with the unsaturated fatty acid.

Furthermore, the ceramic layer may be formed of a plurality of ceramic particles, and the ceramic particles may have a median particle diameter (D50) of about 1 nm to about 40 nm.

Furthermore, in the nanoparticles, the thermal conductivity of the core may be greater than the thermal conductivity of the shell, and the thermal conductivity of the shell may be greater than the thermal conductivity of the lubricating oil.

Furthermore, the nanoparticles may remain uniformly dispersed within the lubricating oil, without aggregation and sedimentation.

Furthermore, the unsaturated fatty acid may be provided as an unsaturated fatty acid having 10 to 25 carbon atoms.

Furthermore, the amine-based compound may be at least one selected from a primary aliphatic amine having 5 to 18 carbon atoms, and an aliphatic diamine having 2 to 6 carbon atoms.

Furthermore, the base oil may be selected from among a mineral oil and a synthetic oil.

Furthermore, the nanodiamonds and the unsaturated fatty acid may be present at a wt % ratio of about 1:0.01 to about 1:1.

Furthermore, the nanodiamonds and the amine-based compound may be present at a wt % ratio of about 1:0.01 to about 1:1.

Furthermore, the nanoparticles may be included at a concentration in the range of about 0.001 wt % to about 1.00 wt % relative to the lubricating oil.

Furthermore, the lubricating oil composition may further include at least one from among an antioxidant, a detergent dispersant, a viscosity index improver, a pour point depressant, an oiliness agent, and an anti-foaming agent.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
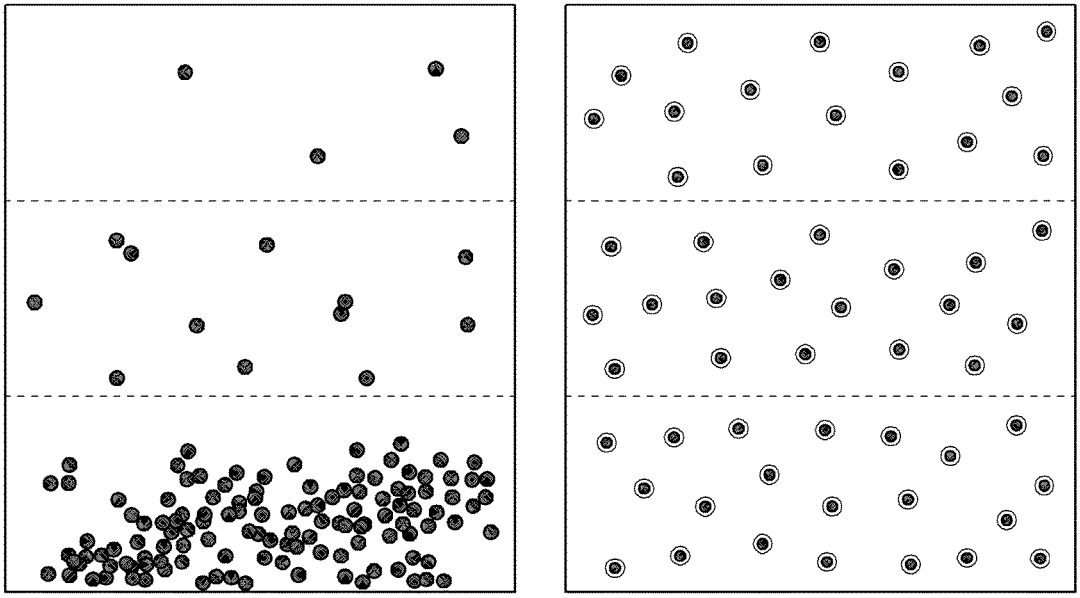
FIG. 1 shows simplified representations of a lubricating oil containing prior art nanodiamonds, and a lubricating oil composition according to an embodiment of the disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. The embodiments are merely described below, by referring to the figures, to explain aspects. As used herein, the term "and/or" includes any and all combinations of one or more of the associated listed items. Expressions such as "at least one of" when preceding a list of elements, modify the entire list of elements and do not modify the individual elements of the list.

One embodiment of the disclosure is illustrated in the accompanied drawings. However, the present inventive concept may be implemented in various other forms and should not be construed as being limited to the examples described in the present specification. Rather, the present examples are provided for a full understanding of the present inventive concept and to sufficiently convey the scope of the present inventive concept to those of ordinary skill in the art in the relevant technical field. Like reference numerals denote like elements throughout the specification.

The terms used herein are only to describe a particular example and should not be construed as limiting the present inventive concept. As used herein, the singular forms are intended to include the plural forms including "at least one" as well, unless the context clearly indicates otherwise. The term "at least one" shall not be construed as being limited to a singular form. As used herein, the term "and/or" may be interpreted as including any and all combinations of one or more of the listed components. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms used in the present application (including technical and scientific terms) have the same meaning as generally understood by those of ordinary skill in the art in the technical field to which the present disclosure belongs. Further, the terminology as defined in the commonly used dictionary shall be interpreted as having the meaning appropriate to the context in the related technology and the present disclosure and shall not be interpreted as having an idealized or excessively formal meaning.

While specific examples and are described herein, there may be alternatives, modifications, variations, improvements, and substantial equivalents of the examples disclosed herein, including those that are not presently unforeseen or unappreciated, may arise from applicants or those skilled in the art. Therefore, the accompanied claims that are submitted and amendable are intended to encompass all such alternatives, modifications, changes, improvements and substantial equivalents.

A lubricating oil composition according to an embodiment of the disclosure includes a lubricating oil additive and a lubricating oil.

The lubricating oil additive may have nanoparticles in a core-shell structure, dispersed in a base oil.

The nanoparticles may include nanodiamonds, and the nanodiamonds may have a surface thereof hydrophobically modified by a surface treatment using a surface treatment material.

Furthermore, the base oil may be selected from among a mineral oil and a synthetic oil.

The base oil may be provided as one or more mineral base oils, or one or more synthetic base oils.

The base oil may be provided as a mixture oil containing two or more selected from among the mineral base oils and the synthetic base oils.

Base oils are oils constituting lubricants, and although it varies from one product to another, base oils constitute a large part of the finished lubricant products. Commonly used as base oils in the art are mineral base oils. Mineral oils are oils produced by vacuum distillation and purification of residual fractions remaining from atmospheric distillation of crude oil, and synthetic oils generally refer to base oils that are produced by means independent of the refining process of crude oil. Generally, due to their high saturation levels, base oils have low viscosity and are produced so as to be highly stable under high-temperature high-pressure conditions, and have an extremely high boiling point.

Nanodiamonds refer to diamonds having a small, nanoscale particle diameter. Nanodiamonds consist of discrete particles having a size of a few nanometers, but due to their structural and chemical properties nanodiamond particles tend to aggregate, and nanodiamonds exist as aggregates having a size from about 100 nm to about 1,000 nm, rather than as discrete particles.

Nanodiamond particles have a crystal structure that has sp3 hybridized orbitals in the core and sp2 orbitals on the surface, such that while the characteristics of diamond are intact in the core, the surface may have various atoms and molecules bound thereto through dangling bonds.

Furthermore, since the proportion of surface atoms is high in a nanodiamond particle, Van der Waals forces acting between adjacent particles are strong, and coulombic repulsions may be generated between particles with the same charge, and steric repulsions generated from solvation or adsorption layer may be in effect. Furthermore, the ability to form hydrogen bonds of functional groups on the surface of nanodiamond particles may be in effect. Under the influence of these forces, nanodiamonds show the tendency to aggregate.

Therefore, in order to utilize nanodiamonds as a lubricant oil material, it is necessary to first disaggregate aggregates of nanodiamonds.

The nanodiamonds may have on the particle surface at least one functional group from among a carboxyl group (—COOH), a hydroxyl group (—OH), and an amino group (—$NH_2$).

The nanodiamonds were analyzed by FT-IR to confirm that such functional groups as carboxyl groups, hydroxyl groups, and amino groups are generally present on the nanodiamond's surface. Due to the presence of oxygen-containing functional groups on the surface, the nanodiamonds may be highly miscible with hydrophilic solvents and yet, less compatible with oils.

The presence of the above functional groups on the surface allows the nanodiamonds to form a chemical bond with a hydrophobic material.

The hydrophobic material may bind to nanodiamonds in a manner that covers the entire surface thereof, and this may result in forming the shell described above.

Accordingly, the nanoparticles may have the core formed of the nanodiamond, and the shell formed of the hydrophobic material. For example, the shell may include an unsaturated fatty acid and/or an amine-based compound. As another example, the shell may further include a ceramic layer surrounding the core, and the ceramic layer may be surface-modified with the unsaturated fatty acid and/or the amine-based compound.

Since the surface of the core formed of the nanodiamond is completely covered by the shell formed of the hydrophobic material, aggregates formed at the particle's surface may be disaggregated and dispersed within oil as small particles.

Small particles immersed in a fluid, even without any energy being supplied, undergo 'the Brownian motion', which is the random erratic movement. As a result, the nanodiamonds can be uniformly and evenly distributed throughout the oil and can naturally maintain such a dispersion state.

FIG. 1 shows simplified representations of a lubricating oil containing prior art nanodiamonds, and a lubricating oil composition according to an embodiment of the disclosure.

FIG. 1A depicts a dispersion state when regular nanodiamonds are added to the lubricating oil, and FIG. 1B depicts a dispersion state when the lubricating oil additive containing the above nanoparticles is added to the lubricating oil.

As shown in (A) of FIG. 1, the prior art nanodiamonds tend to aggregate and exist as aggregates, rather than being dispersed as discrete particles. The presence of such aggregates may hinder dispersion of the nanodiamonds and cause more particles to exist in the lower portion of the solution than the upper portion thereof, and may give rise to sedimentation.

On the other hand, as shown in (B) of FIG. 1 illustrating the lubricating oil composition according to an embodiment of the disclosure, since the nanodiamonds are dispersed as nanoparticles with a hydrophobic shell formed on the surface, the nanoparticles do not undergo aggregation or sedimentation, but rather, the nanoparticles are uniformly dispersed within the lubricating oil through the Brownian motion.

Figure 2:
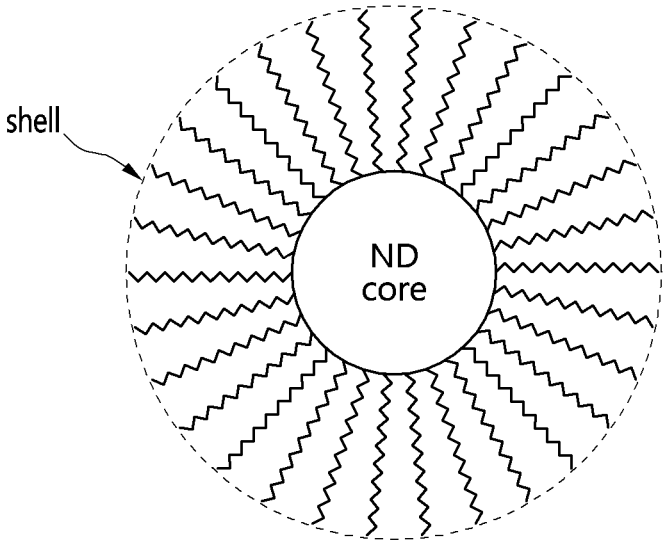
FIG. 2 depicts a nanoparticle according to an embodiment of the disclosure.

FIG. 2 depicts a nanoparticle according to an embodiment of the disclosure.

As depicted in FIG. 2, the core of the nanoparticle may be formed of the nanodiamond, and the shell may include an unsaturated fatty acid and/or an amine-based compound.

The nanodiamonds as described above, include a functional group on the surface, such as a carboxyl group (—COOH), a hydroxyl group (—OH), an amino group (—$NH_2$), and the like. Therefore, on the surface of the nanodiamond, the unsaturated fatty acid or the amine-based compound may directly form a chemical bond.

Among the above-mentioned functional groups on the nanodiamond's surface, an amino group has the highest reactivity, and the amino group can react with the carboxyl group of the unsaturated fatty acid to form a covalent bond.

The amine-based compound may be added as an aid that helps the nanodiamonds surface-treated by the unsaturated fatty acid remain dispersed within the oil. The amine-based compound may act as a catalyst that helps the nanodiamonds and the unsaturated fatty acid form a stable bond more quickly.

The amine-based compound contains hydrogen and thus can form a covalent bond with carboxyl groups on the surface of the nanodiamond.

The unsaturated fatty acid and the amine-based compound, depending on the type, may form a hydrogen bond with oxygen in the carboxyl group and the hydroxyl group on the surface of the nanodiamond.

The unsaturated fatty acid may be an unsaturated fatty acid having 10 to 25 carbon atoms. Preferably, the unsaturated fatty acid may be an unsaturated fatty acid having 15 to 22 carbon atoms.

The unsaturated fatty acid refers to a fatty acid that has one carboxyl group in the R—COOH form and has at least one double bond in the aliphatic chain. Generally, as the chain length of an aliphatic compound increases, that is, the number of carbon atoms increases, the compound exhibits stronger hydrophobicity.

The unsaturated fatty acid may be at least one selected from among omega-3 fatty acids, omega-6 fatty acids, omega-7 fatty acids, and omega-9 fatty acids.

The unsaturated fatty acid may be at least one selected from among α-linolenic acid (ALA), stearidonic acid (SDA), eicosatrienoic acid (ETE), eicosatetraenoic acid (ETA), eicosapentaenoic acid (EPA), heeneicosapentaenoic acid (HPA), docosapentaenoic acid (DPA), docosahexaenoic acid (DHA), linoleic acid (LA), γ-linolenic acid (GLA), calendic acid, eicosadienoic acid, dihomo-γ-linolenic acid (DGLA), arachidonic acid, docosadienoic acid, adrenic acid, osbond acid, tetracosatetraenoic acid, palmitoleic acid, vaccenic acid, rumenic acid, paullinic acid, oleic acid, elaidic acid, gondoic acid, and mead acid.

The unsaturated fatty acid is not limited to the aforementioned types of fatty acids but rather, may be any fatty acid that contains at least one double bond and has a long aliphatic chain.

According to an embodiment, the nanodiamonds and the unsaturated fatty acid may be mixed at the wt % ratio of about 1:0.01 to about 1:1, but the wt % ratio is not limited thereto. Furthermore, appropriate ratios of the unsaturated fatty acid to the nanodiamonds that result in the most desirable dispersibility may vary depending on the type of nanodiamonds and the type of oil.

The amine-based compound may be selected from among a primary aliphatic amine having 5 to 20 carbon atoms, and an aliphatic diamine having 2 to 6 carbon atoms.

In particular, the amine-based compound may be at least one selected from among hexadecylamine, heptadecylamine, octadecylamine, nonadecylamine, dodecylamine, methylenediamine, ethylenediamine, propane-1,3-diamine, butane-1,4-diamine, pentane-1,5-diamine, and hexane-1,6-diamin.

As likewise described with respect to the unsaturated fatty acid, hydrophobicity of the amine-based compound increases as its aliphatic chain length increases, and therefore any primary amines or diamines with a long chain may be used.

According to an embodiment, the nanodiamond and the amine-based compound may be mixed at the wt % ratio of about 1:0.01 to about 1:1, but is not limited thereto.

Figure 3:
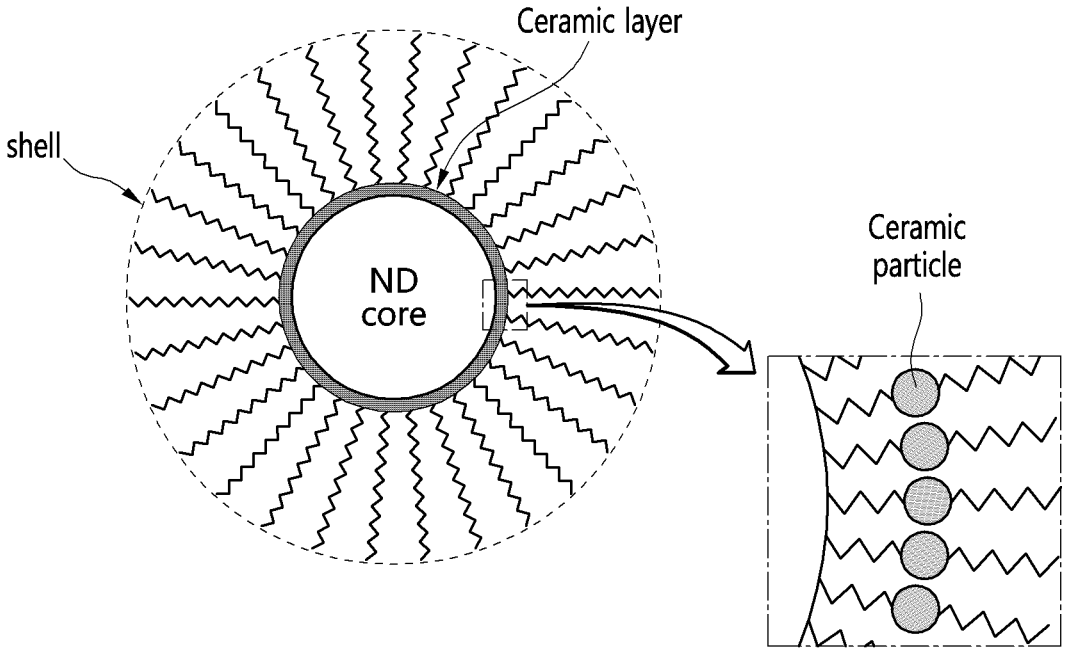
FIG. 3 illustrates another embodiment of FIG. 2.

FIG. 3 illustrates another embodiment of FIG. 2.

As shown in FIG. 3, the shell may further include a ceramic layer surrounding the core, and the ceramic layer may be surface-treated by the unsaturated fatty acid and/or the amine-based compound.

The ceramic layer may be prepared so as to have on the surface one or more functional groups selected from a carboxyl group, a hydroxyl group, and an amino group.

The ceramic layer may be made of a plurality of ceramic particles, wherein the ceramic particles may have a median particle diameter (D50) of about 1 nm to about 40 nm. Accordingly, the ceramic particles may be bound preponderantly on the surface of the nanodiamonds, and this may lead to a stable formation of the shell formed of the ceramic particles.

The nanoparticles may further include a mediator material capable of forming a linkage between the nanodiamond and the ceramic layer.

The mediator material may be an aliphatic diamine. More specifically, the mediator material may be provided as an aliphatic diamine having 2 to 6 carbon atoms.

The mediator material is an aliphatic compound having a functional group at both ends thereof, and this functional group may be any functional group capable of forming a bond with at least one functional group from among a carboxyl group, a hydroxyl group, and an amino group.

To demonstrate a mechanism of formation of a core-shell structure of the nanoparticle, a case study using an aliphatic diamine as the mediator material will be illustrated below.

The aliphatic diamine is a linear compound and has an amino group at both ends.

Of the amino groups at both ends, the amino group at one end may form a chemical bond with carboxyl groups on the surface of the nanodiamond, and the amino group at the other end may form a chemical bond with carboxyl groups on the surface of the ceramic layer.

The ceramic layer may have be hydrophobically surface-treated by an unsaturated fatty acid and/or an amine-based compound. The unsaturated fatty acid and/or the amine-based compound may chemically bind to the surface of the ceramic layer to thereby impart hydrophobicity to the surface of the nanodiamond.

To form the shell, the nanodiamond or the ceramic layer may have a surface treatment material bound to its surface.

The surface treatment material is not limited to the unsaturated fatty acid or the amine-based compound, and may be any material as long as it forms a chemical bond with a functional group on the surface of the ceramic layer or on the surface of the nanodiamond, and has hydrophobicity.

The surface treatment material may be an alkyl silane compound including an alkoxy silane and an epoxy silane.

The surface treatment material may be an organic compound having an oxygen-containing functional group such as a carboxyl group (—COOH), a hydroxyl group (—OH), and a ketone group (—CO—), an amino group, and a thiol group.

The surface treatment material may be a copolymer such as ethylene vinyl acetate (EVA), or may be a linear polymer including polyvinyl alcohol (PVA), polytetrafluoroethylene (PTFE), and the like.

The surface treatment material may be a cyclolinear polymer including polyaniline, polypyrrole, and the like.

The nanoparticles are provided in the form of a lubricating oil additive dispersed in a base oil, and this lubricating oil additive can be mixed with a lubricating oil to produce a lubricating oil composition with the nanoparticles uniformly dispersed in the lubricating oil.

Since the nanoparticles have a core-shell structure, the nanoparticles have dispersibility inside a lubricating oil additive dispersed in the base oil, and even when the lubricating oil additive is blended with different types of lubricating oils, the dispersibility of the nanoparticles can remain stable.

The lubricating oil may be selected from lubricant oils used as motor oils, wind turbine oils, insulating oils, and oils used across other industries.

According to an embodiment of the disclosure, the lubricating oil composition may further include other additives, depending on its intended purpose of use. Examples of the other additives may include antioxidants, detergent dispersants, viscosity index improvers, pour point depressants, oiliness agents, and anti-foaming agents.

Hereinbelow, an embodiment of the disclosure will be described in detail based on performance tests.

In the performance tests of lubricating oils, the test fluid is a lubricating oil composition according to an embodiment of the disclosure, and the control liquid is a regular lubricating oil without the above lubricating oil additive.

The test fluid was prepared so as to contain the nanodiamonds in an amount of 0.03 wt % relative to the lubricating oil. Comparison between the results for the test fluid and the control fluid will be made as needed.

Figure 4:
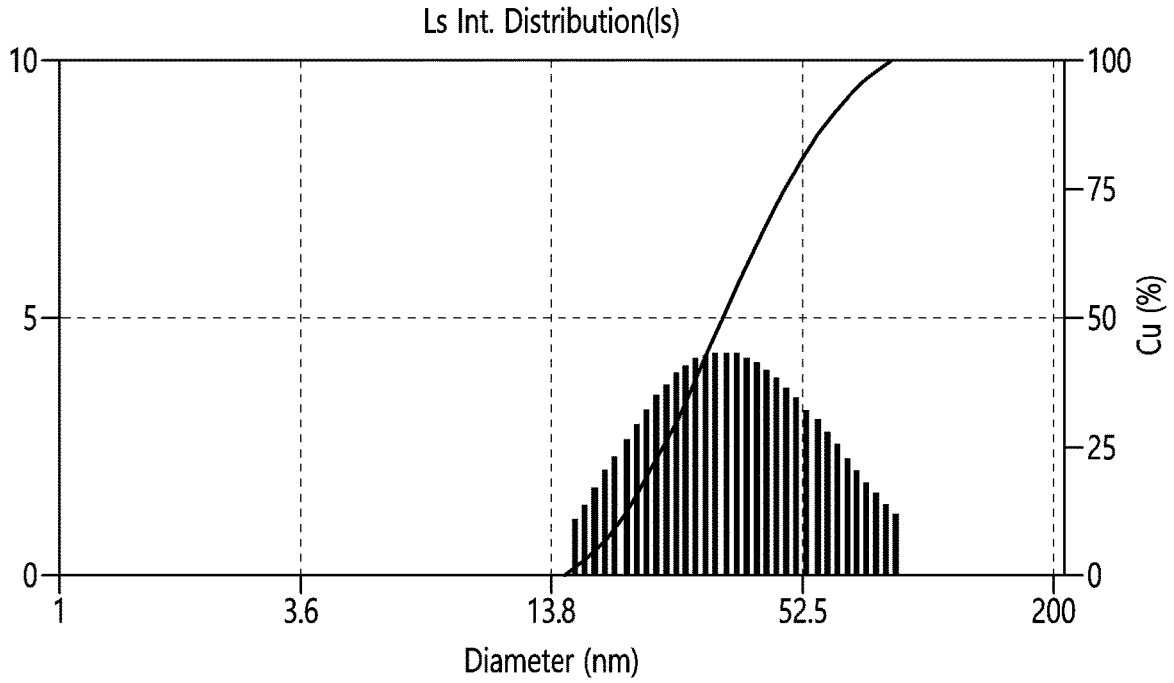
FIG. 4 shows the result of measuring a lubricating oil composition according to an embodiment of the disclosure by a particle size analyzer.

FIG. 4 shows a particle distribution of a lubricating oil composition according to an embodiment of the disclosure, as measured by a particle size analyzer.

As shown in FIG. 4, the test fluid was found to have an average particle size of about 40 nm, and an extremely narrow particle size distribution from 15 nm to 110 nm.

This indicates that in the lubricating oil composition according to an embodiment, the nanoparticles are dispersed in lubricating oil as small-size particles, without forming aggregates.

Figure 5:
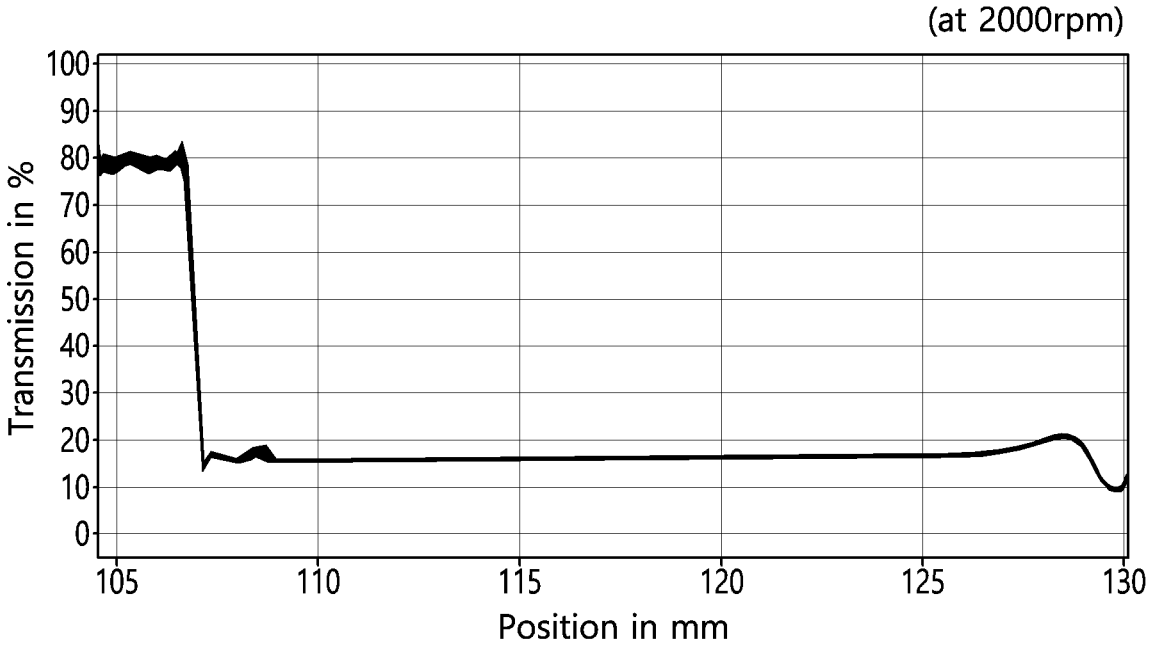
FIG. 5 and FIG. 6 show the results of a long-term dispersion stability test performed on a lubricating oil composition according to an embodiment.
Figure 5:
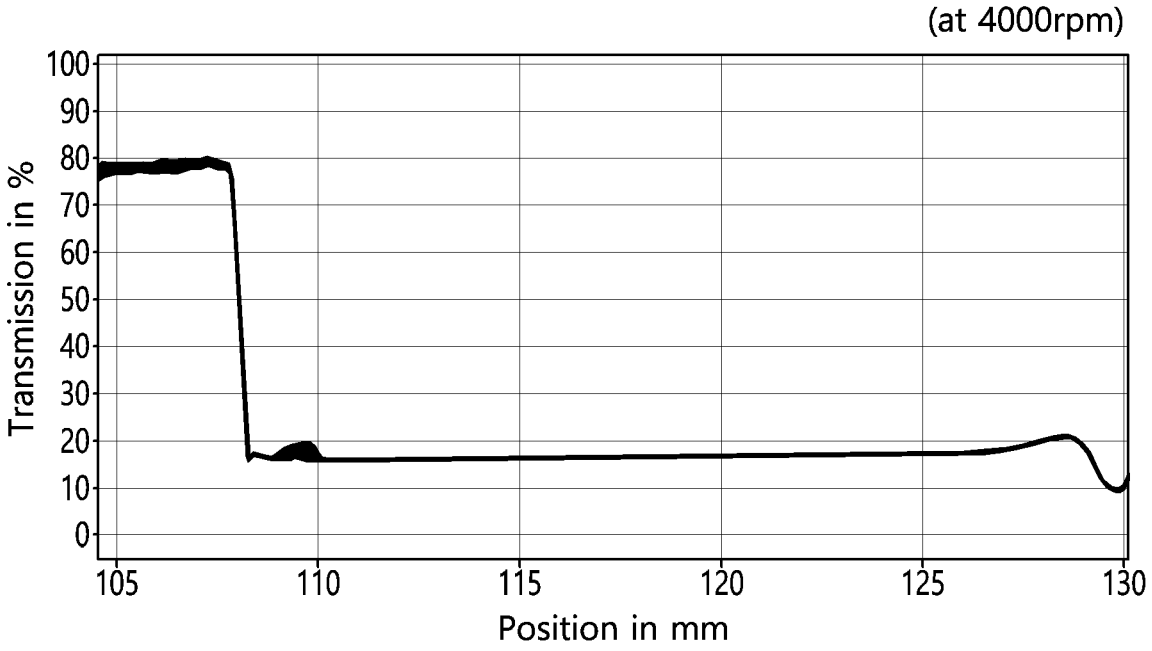
Figure 6:
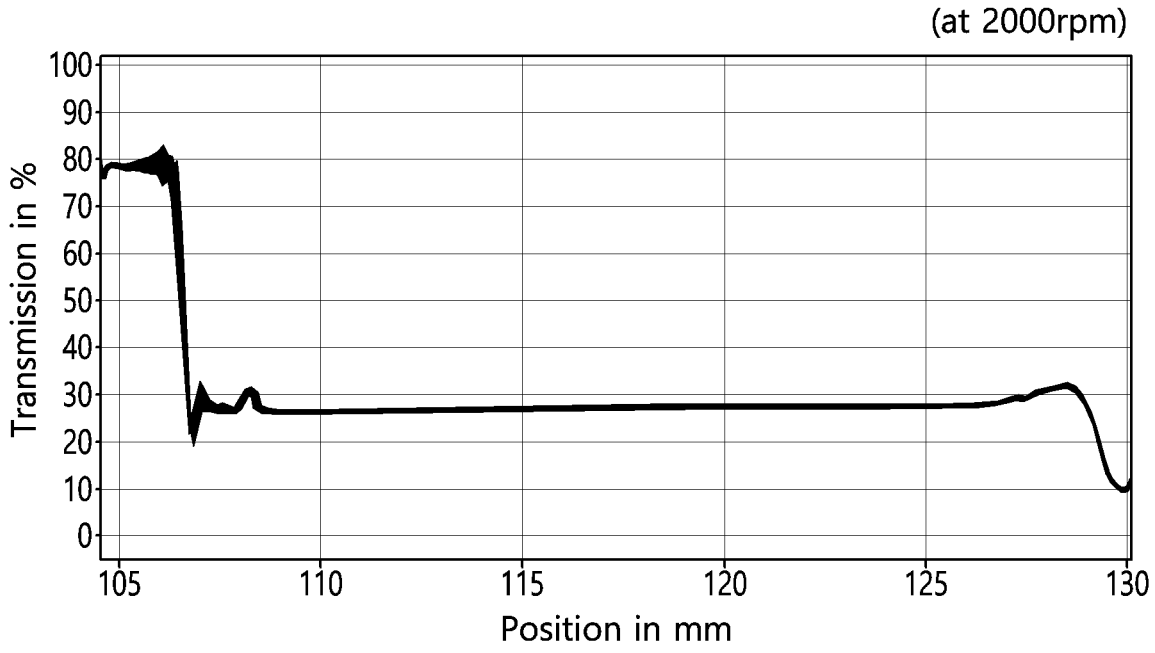
Figure 6:
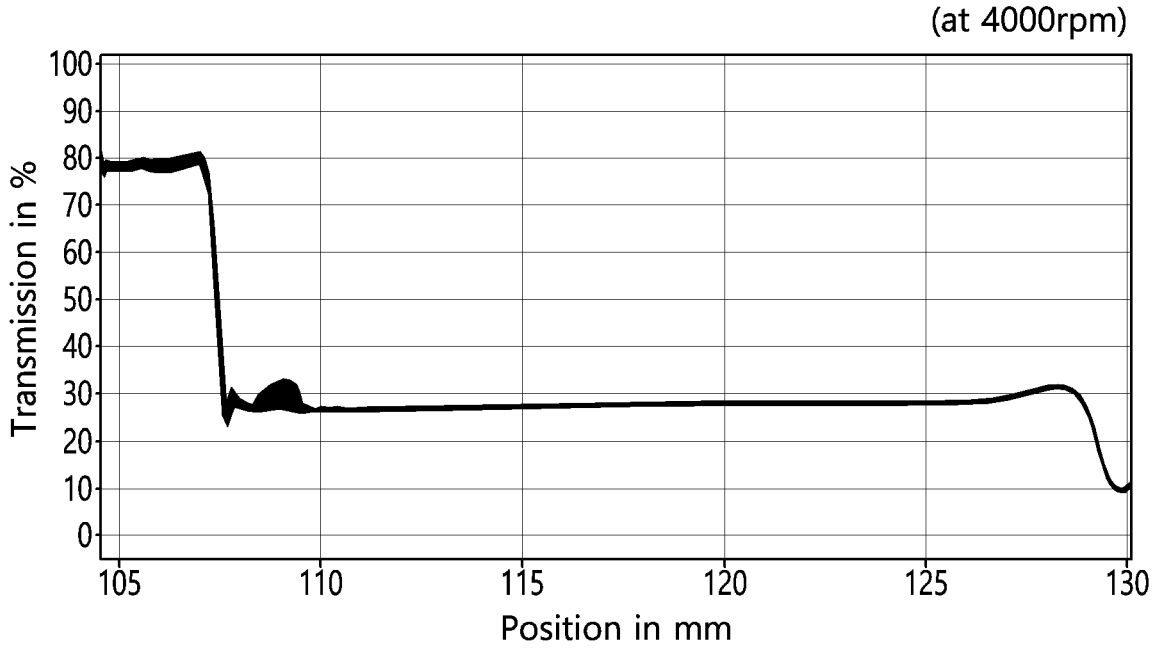

FIG. 5 and FIG. 6 show the results of a long-term dispersion stability test of a lubricating oil composition according to an embodiment.

The long-term dispersion stability test was performed at a temperature of 25° C. and a relative humidity of 50%, using the LUMiSizer dispersion analyzer, which is a dispersion stability analysis system.

The LUMiSizer includes an NIR light source and a centrifuge system. As the sedimentation rate of suspended particles is accelerated by subjecting a sample-filled cell to centrifugation at a high speed, the entire cell is illuminated by NIR light at the same time. As a result, some of the light is absorbed by the sample and the remainder is transmitted through the sample. By continuously measuring this transmitted light by an NIR sensor, a transmission profile can be obtained. This transmission profile shows changes in transmittance of solution over a course of particle sedimentation. As particles settle on the bottom of the cell, the number of particles remaining in the upper portion of the cell decreases, and accordingly, the recorded transmittance becomes gradually higher.

Since a single transmission profile (one line graph) shows the transmittance measured at a certain time interval, a gap between two different profiles represents the distance by which particles have migrated over a period of time. Therefore, the migration rate (μm/s) of particles can be calculated by dividing the gap between profiles by a measurement time interval.

FIG. 5 shows a transmission profile of the control fluid, and FIG. 6 shows a transmission profile of the test fluid. Transmission profiles are acquired for samples undergoing centrifugation at 2,000 rpm and 4,000 rpm, the settling rate and dispersion stability of each sample can be obtained by a pair-wise comparison of distance by which the transmission profiles have moved.

Comparison of FIG. 5 and FIG. 6 shows that the transmission profile in FIG. 6 has a smaller migration distance than that of FIG. 5. This indicates that there was little sedimentation of nanoparticles in lubricating oil, contributing to maintaining its dispersibility for a long period of time.

Figure 7:
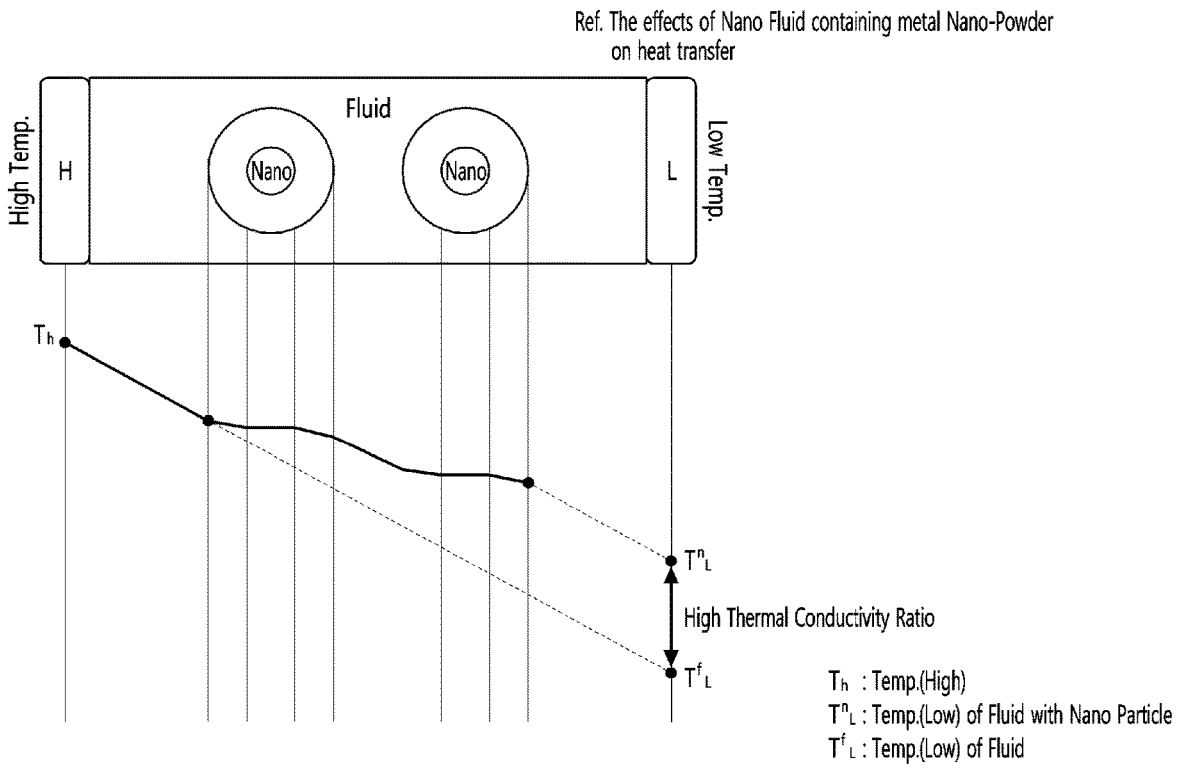
FIG. 7 is a schematic diagram illustrating an enhanced thermal conductivity profile of a nanofluid.

FIG. 7 is a schematic diagram showing an enhanced thermal conductivity profile of a nanofluid.

With reference to FIG. 7, the heat transfer mechanism in nanofluids is described as follows. Enhanced thermal conductivity of fluids with nanoparticles dispersed therein was first reported in 1995 by Argonne National Labs, USA, and these fluids are referred to as 'nanofluids'.

As a general phenomenon, heat transfers from a place of higher temperature to a place of lower temperature. In machines, the place of higher temperature may be areas subjected to friction from rotations, and the place of lower temperature may be any area in the periphery of the place of higher temperature.

FIG. 7 shows fluid temperatures between the place of higher temperature and the place of lower temperature, and illustrates both cases of using a regular fluid, and a nanofluid. The nanofluid refers to an oil having dispersed therein core-shell particles of nanodiamonds surface-treated according to an embodiment of the disclosure. $T_h$ represents the temperature of the place of higher temperature, $T^n_L$ represents the temperature of the place of lower temperature, wherein heat is transferred via the nanofluid, and $T^f_L$ represents the temperature of the place of lower temperature where heat is transferred via the regular fluid. The smaller the slope of the graph, the smaller the temperature difference between the place of higher temperature and the place of lower temperature, and this indicates a faster heat transfer rate.

As shown in FIG. 7, while the regular fluid shows a near-linear decrease of temperature change ($T_h \rightarrow T^f_L$), the nanofluid shows a temperature change ($T_h \rightarrow T^n_L$) wherein the slope changes around the area where nanopowder is present. More specifically, inside the nanofluid, the core portion of the nanoparticles (nanodiamonds) shows a near-horizontal line of thermal conductivity, while the shell portion of the nanoparticles has a certain temperature gradient. Here, the temperature gradient in the shell portion has a smaller slope compared to the slope of an external temperature gradient.

From here, it could be confirmed that the nanofluid has a faster heat transfer rate than the regular fluid. This can be attributed to the fact that since the nanodiamonds has superior thermal conductivity to fluids, the rate at which heat is transferred within the nanoparticles is drastically increased in comparison to the rate at which heat is transferred in a fluid, and thus, the overall heat transfer performance of the fluid is enhanced.

Figure 8:
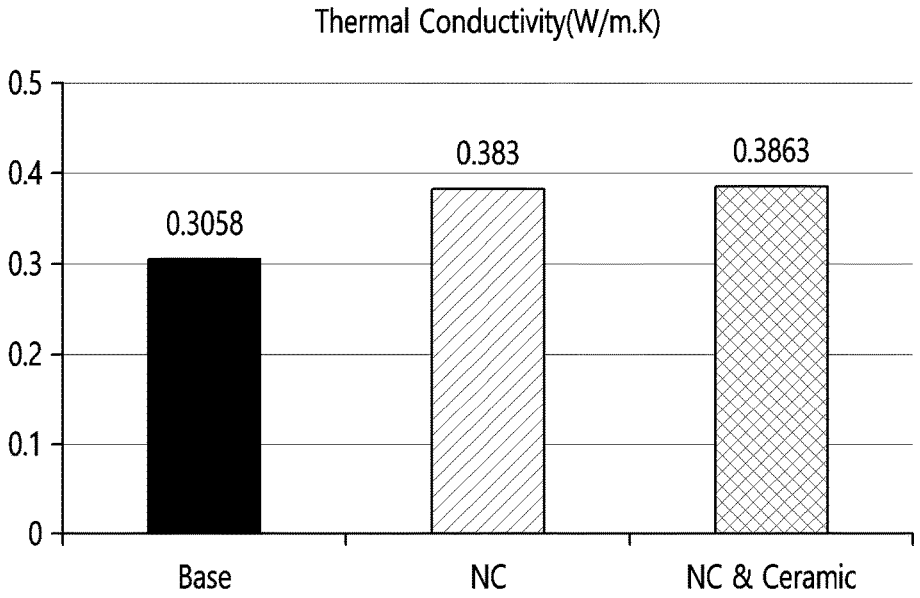
FIG. 8 shows the results of a thermal conductivity test performed on a lubricating oil composition according to an embodiment.

Hereinbelow, the results of a thermal conductivity test shown in FIG. 8 are analyzed in light of the enhanced thermal conductivity profile of nanofluids as described above.

FIG. 8 shows the results of a thermal conductivity test performed on a lubricating oil composition according to an embodiment. Here, the thermal conductivity is measured as an average of five test measurements.

According to FIG. 8, a regular lubricant oil has a thermal conductivity of 0.3058. On the other hand, a lubricating oil composition containing nanoparticles having the unsaturated fatty acid and the amine-based compound attached to the surface of the nanodiamond has a thermal conductivity of 0.3830, and a lubricating oil composition containing nanoparticles having the surface-modified ceramic layer on the surface of the nanodiamond has a thermal conductivity of 0.3863. This indicates that compared to the regular lubricant oil, the lubricating oil composition according to the disclosure has improved thermal conductivity. This result is attributable to the enhanced thermal conductivity profile of nanofluids described above.

Taken together, the lubricating oil composition according to the disclosure for its superior thermal conductivity has a cooling effect on machines, and since the lubricating oil cools fast, thermal oxidation of the lubricating oil can be delayed. This can also prolong the service-life of the lubricating oil.

Figure 9:
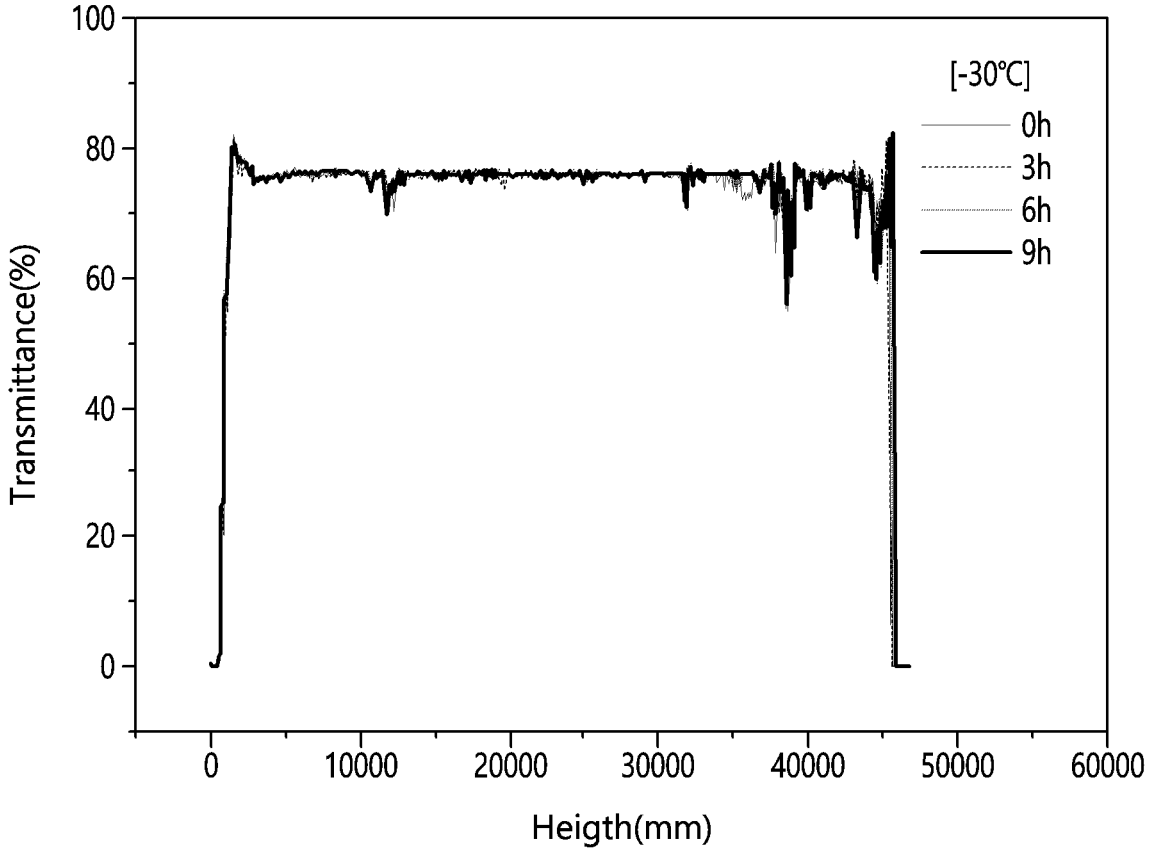
FIG. 9 and FIG. 10 show the results of a Turbiscan test performed at different temperatures on a lubricating oil composition according to an embodiment.
Figure 10:
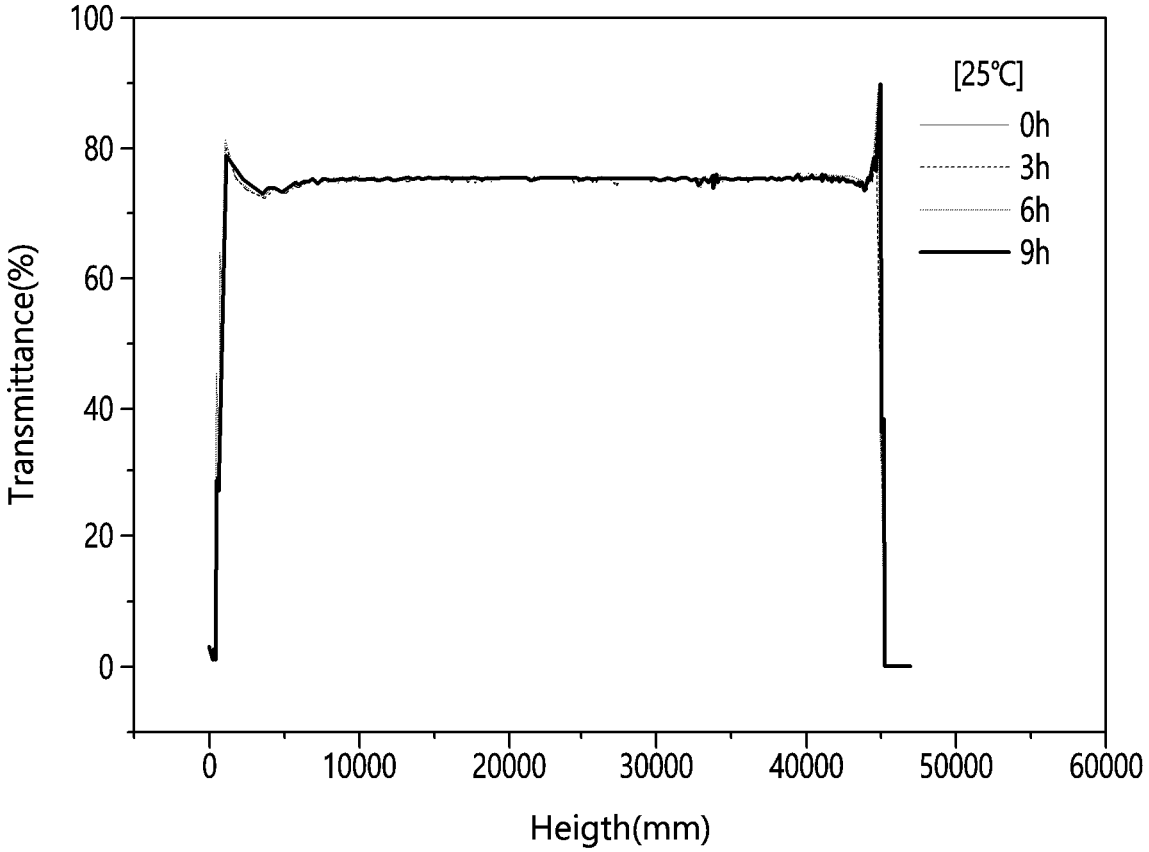

FIG. 9 and FIG. 10 show the results of a Turbiscan test performed at different temperatures on a lubricating oil composition according to an embodiment.

FIG. 9 shows the result from the test fluid as measured at −30° C., and FIG. 10 shows the result from the test fluid as measured at 25° C. The x-axis indicates the sample height, the y-axis indicates transmission flux (%), and changes in flux (%) with respect to the entire sample height after scanning every 3 hours are shown.

Turbiscan is a dispersion stability analyzer using multiple light scattering, and consists of an NIR light source, a transmission detector, and a backscattering detector.

While the cells filled with dispersions are scanned from bottom to top, the amount of light transmitted and backscattered, varying on the dispersion state, are simultaneously measured. Through a function of size and concentration of the suspended particles, any increase in the size of the suspended particles, or a difference in the concentration between the top and bottom of the dispersion leads to a change in transmittance and backscattering flux (%), which permits calculation of a change in dispersion stability.

As shown in FIG. 9 and FIG. 10, transmission profiles of the test fluid, obtained over different periods of time, are nearly identical, indicating that there was no change in the upper portion or lower portion of the sample. This indicates that the nanoparticles dispersed in the lubricating oil remained dispersed without aggregation.

Further, the test fluid shows no significant difference between dispersibility at low temperature (FIG. 9) and dispersibility at room temperature (FIG. 10), indicating that the lubricating oil composition does not suffer a decrease in performance even at low temperatures.

In the foregoing, the disclosure has been described with reference to an example, but this is for illustrative purpose only, and it should be apparent to those skilled in the art that many modifications and other equivalent embodiments of the disclosure are possible. Therefore, variations associated with such modifications and applications should be interpreted as being included in the scope of the disclosure as defined by the appended claims.

According to embodiments of the disclosure, a lubricating oil composition in which a lubricating oil additive containing hydrophobically surface-treated nanodiamonds is mixed and dispersed in a lubricating oil. In such a lubricating oil composition, since the nanodiamond particles are uniformly dispersed and maintain a uniformly dispersed state for a long period of time, dispersion stability and storage stability of lubricating oil can be improved, and superior abrasion resistance of the nanodiamonds can enhance lubricating performance especially when used in rotating machines, and can prolong the service life of machines, and can further provide advantages of improving cooling efficiency, improving fuel consumption, reducing noise, and reducing environmental pollution caused by exhaust gas, and the like.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A lubricating oil additive comprising:

a plurality of nanoparticles; and base oil in which the plurality of nanoparticles are dispersed, wherein each of the plurality of nanoparticles comprises a core and a shell surrounding the core, wherein the core comprises a nanodiamond, and the shell comprises at least one of an unsaturated fatty acid and an amine-based compound, and wherein a thermal conductivity of the core is greater than a thermal conductivity of the shell, and the thermal conductivity of the shell is greater than a thermal conductivity of the base oil.

2. The lubricating oil additive of claim 1, wherein the unsaturated fatty acid is provided as an unsaturated fatty acid having 10 to 25 carbon atoms.

3. The lubricating oil additive of claim 2, wherein the nanodiamonds and the unsaturated fatty acid are present at a wt % ratio of about 1:0.01 to about 1:1.

4. The lubricating oil additive of claim 1, wherein the amine-based compound is at least one selected from a primary aliphatic amine having 5 to 18 carbon atoms and an aliphatic diamine having 2 to 6 carbon atoms.

5. The lubricating oil additive of claim 4, wherein the nanodiamonds and the amine-based compound are present at a wt % ratio of about 1:0.01 to about 1:1.

6. The lubricating oil additive of claim 1, wherein the base oil is selected from among a mineral oil and a synthetic oil.

7. The lubricating oil additive of claim 1, further comprising a ceramic layer between the core and the shell, the ceramic layer surrounding the core.

8. The lubricating oil additive of claim 7, wherein the ceramic layer s surface-treated by the unsaturated fatty acid and/or the amine-based compound.

9. The lubricating oil additive of claim 7, wherein the ceramic layer s surface-treated by the unsaturated fatty acid and/or the amine-based compound.

10. The lubricating oil additive of claim 7, wherein the ceramic layer has, on a surface thereof, one or more functional groups selected from a carboxyl group, a hydroxyl group, and an amino group, and the amino group forms a covalent bond with the unsaturated fatty acid.

11. The lubricating oil additive of claim 7, wherein the ceramic layer is formed of a plurality of ceramic particles, and the ceramic particles have an average particle diameter of about 1 nm to about 40 nm.

* * * * *